United States Patent [19]

Houghton

[11] 4,286,448

[45] Sep. 1, 1981

[54] MILL CONTROL

[75] Inventor: Geoffrey Houghton, Colehill, England

[73] Assignee: Loewy Robertson Engineering Co. Ltd., Poole, England

[21] Appl. No.: 93,187

[22] Filed: Nov. 13, 1979

[51] Int. Cl.[3] ..... B21B 37/00; B21B 13/14

[52] U.S. Cl. ..... 72/21; 72/243

[58] Field of Search ..... 72/243, 242, 6, 21

[56] References Cited

U.S. PATENT DOCUMENTS

| | | | |
|---|---|---|---|
| 3,528,274 | 9/1970 | Rostelli | 72/242 |
| 4,022,040 | 5/1977 | Turley | 72/243 X |
| 4,156,359 | 5/1979 | Verbickas | 72/243 |

*Primary Examiner*—Milton S. Mehr

*Attorney, Agent, or Firm*—Lee, Smith & Jager

[57] ABSTRACT

The invention relates to a control system for setting the crown and/or steer on the rolls of a cluster mill such that the adjustment collars are all driven together but substantially in the desired final ratio to one another throughout the movement. The control system derives a separate control signal for driving each eccentric collar. The circuits for deriving the control signals include means for deriving from crown and steer magnitude signals, a series of crown and steer datum signals, one for each collar, which are proportional to the respective magnitude signals in selected ratios, the crown ratios being preselectable by a selection means and means for progressively increasing the magnitude signals from zero to the desired value.

6 Claims, 3 Drawing Figures

MILL CONTROL

Figure 1A:
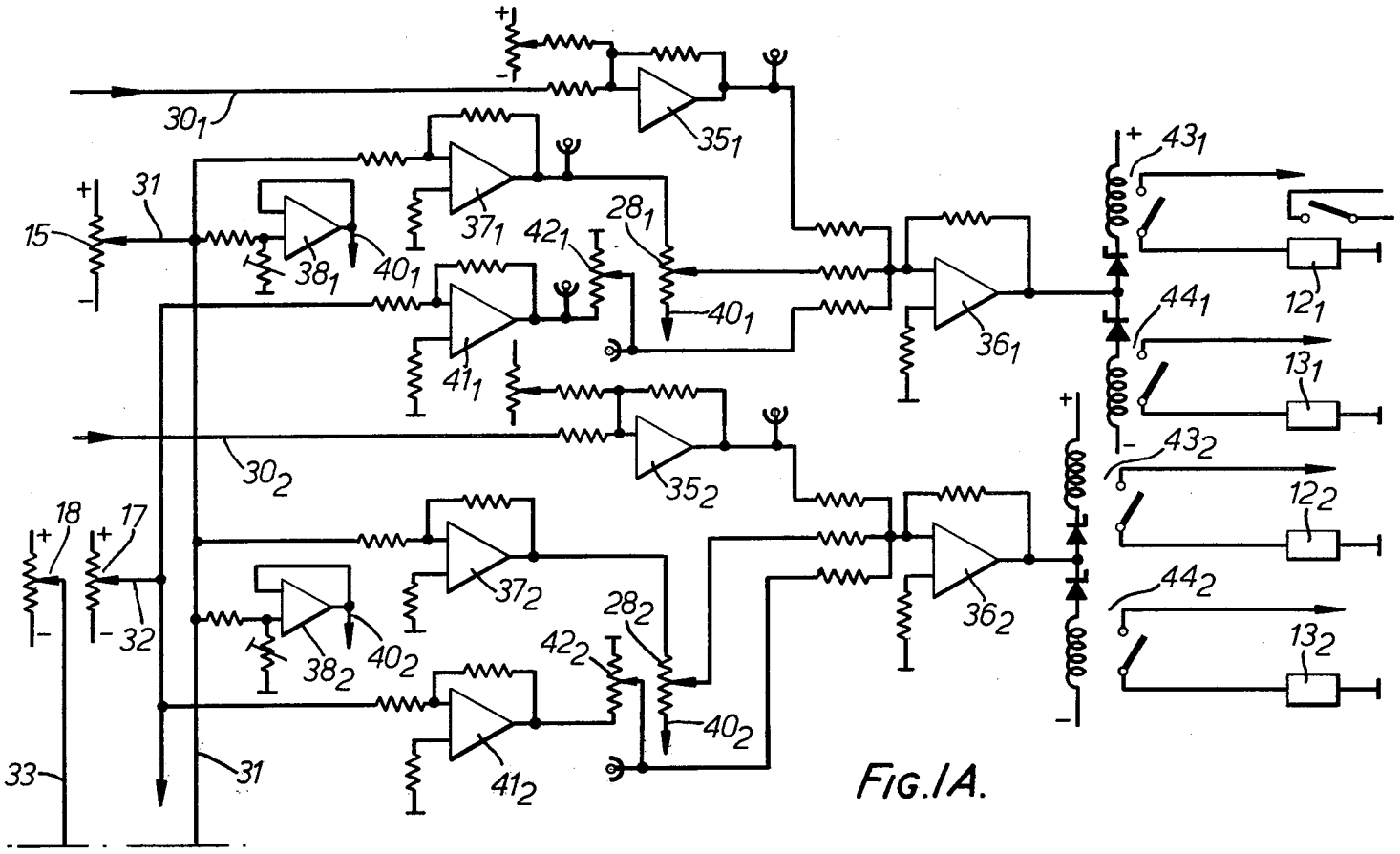

This invention relates to a cluster mill, such as that known as a Sendzimir mill, and is particularly concerned with a setting control for the crown of the rolls.

As is known a cluster mill has two slender work rolls each of which are supported or backed-up by successive first and second sets of intermediate rolls. The rolls of each second set are in turn supported by four assemblies, each of which consists of a shaft having thereon spaced bearings engaging the rolls of the second set and, between those bearings, eccentrically mounted rotatable collars. By the adjustment of the individual eccentric mountings of the collars, the crowns of the intermediate rolls and of the work rolls can be varied as desired.

The eccentric mountings of the collars are individually motor-driven under control of the operator, who has before him indicators showing the displacements of the individual collars relative to the mill housing. The operator is thus able to set up the crown he requires with reasonable precision. There is however a disadvantage of the present crown setting equipment: the operator has to set the eccentric mountings individually and, if he attempts to obtain a large displacement of one collar before the adjacent collars have been displaced from the zero crown position, there is the danger of the resistance to bending of the bearing shaft being so high that the drive motor will stall. He must therefore achieve the required crown in a series of steps, in each of which each collar is displaced in turn by a small amount.

The present invention provides control equipment for the eccentrically mounted collars of a cluster mill, comprising a control circuit for each collar for setting that collar to a displacement determined by the magnitude of a control signal for each collar, a control signal generating circuit for each collar, means for generating a first magnitude signal proportional to a desired crown magnitude, means for generating from the first magnitude signal a series of crown datum signals, one for each collar, which series of crown datum signals are proportional to the first magnitude signal in a pre-selected ratio, selection means for preselecting this ratio, each of the control signal generating circuits being arranged to receive an associated one of the crown datum signals and a position signal representing the position of its associated collar, whereby each control signal is dependent on the difference between its position signal and the associated crown datum signal. To set up a required crown, the operator first adjusts the selection means to give the desired ratios of displacements of the collars, and then adjusts a crown magnitude circuit from zero progressively to the desired crown magnitude; as the crown magnitude circuit is adjusted, the displacements of all the collars change simultaneously, but the displacements are at all times in the desired ratios.

It is also necessary to adjust the collars relative to one another for "steer" in order to correct any tendency for the rolled material to depart laterally from its set path. For steer, one work roll and its supporting rolls are effectively tilted relative to the other work roll. Steer may be applied to flat rolls or when the rolls are crowned, the displacements of the collars for steer being superposed on their displacements for crown. For enabling steer to be applied, the control equipment of the present invention may include means for applying to the positional control circuits steer signals which again are in preset ratios but have adjustable magnitudes and which, in the absence of an applied crown, cause the collar displacements to vary progressively along the length of the rolls.

Figure 1B:
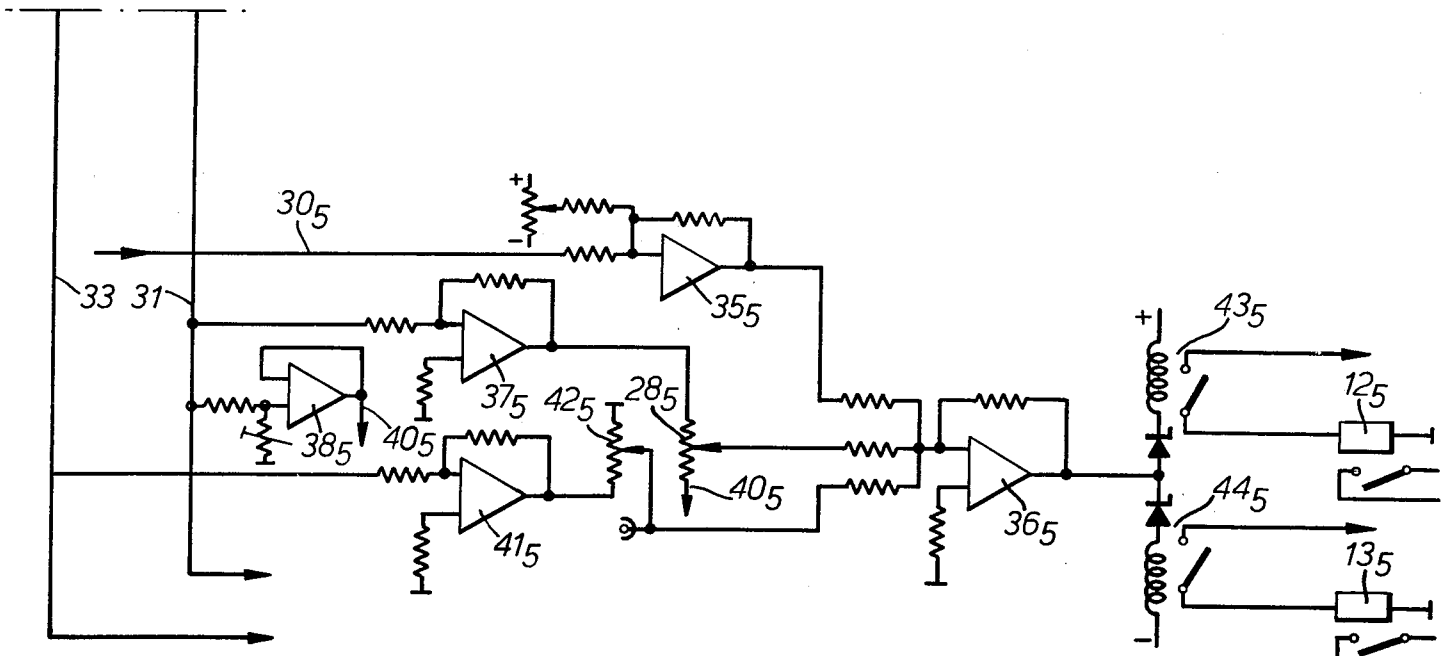
Figure 2:
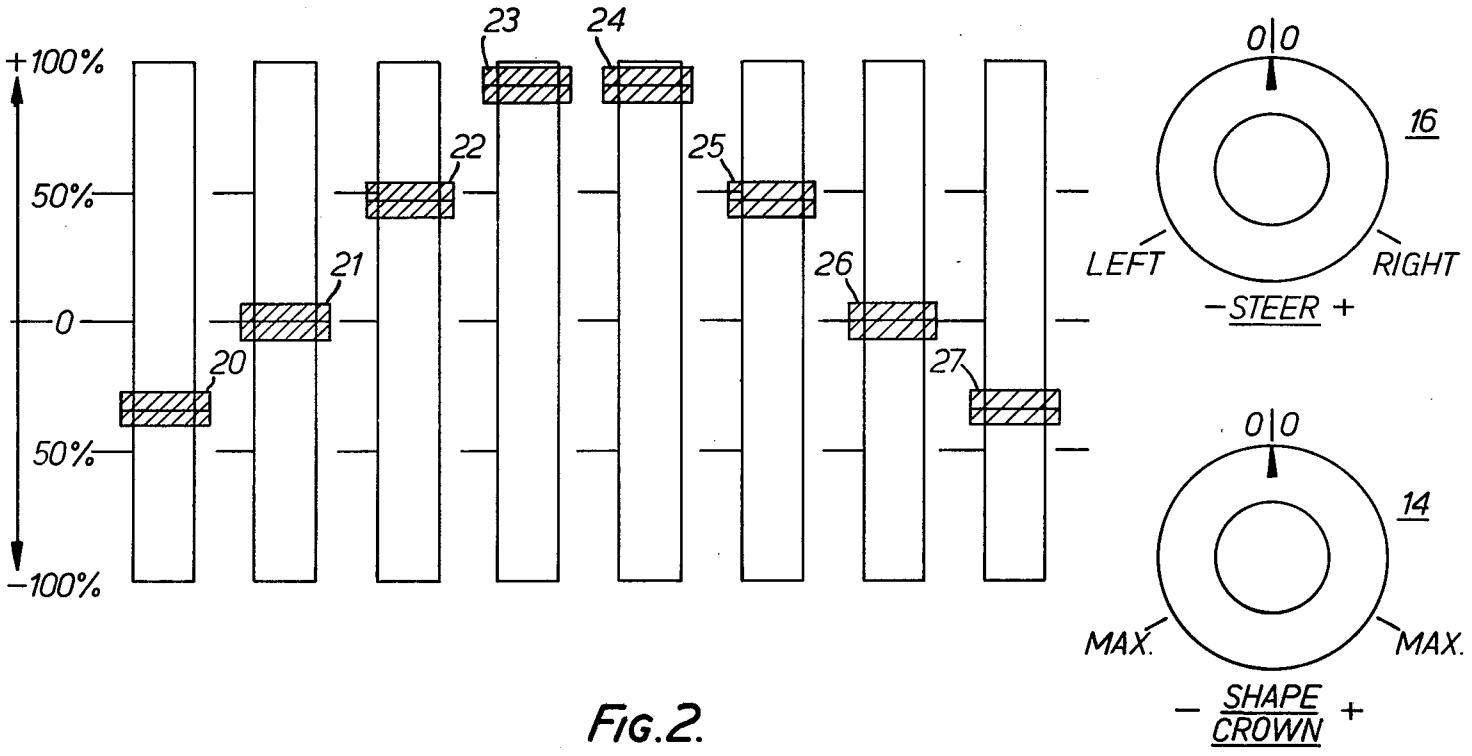

The invention will be more readily understood, by way of example from the following description of a crown and steer control system for a cluster mill, reference being made to the accompanying drawings, in which FIGS. 1A and 1B together form a schematic circuit diagram of the control circuit and FIG. 2 illustrates the manual controls.

The drawings to be described are confined to the position control equipment for the eccentrically mounted collars of the cluster mill, which is of an already known type. It is sufficient to explain that although the two rolls of the cluster mill may have other configurations, in the present example they have a 1-2-3-4 configuration on each side of the pass-line. The rolls below the pass-line are not controlled for crown and steer; above the pass-line, the eccentric mountings of the collars of the shafts of only the inner pair of the final four back-up rolls are controlled. The eccentric mounting of each collar of the controlled shafts has an integral segment gear and the segment gears of corresponding collars of the two controlled shafts mesh with a rack driven by a hydraulic motor. In the example to be described there are eight collars on each shaft, although the number of collars may differ from that value being either even or odd, and hence there are eight hydraulic drive motors which are individually controlled. Each motor is controlled by an UP relay 12 or a DOWN relay 13 (FIGS. 1A and 1B) which when energised cause the collar to be effectively displaced away from, and towards, the mill pass-line respectively. The drive motors for the collars could be actuated hydraulically and/or under proportional control.

The control equipment illustrated relates to a mill having eight collars numbered 1 to 8 along the roll barrel length. FIG. 1A shows the position control circuits for collars 1 and 2, those for collars 3 and 4 being similar and FIG. 1B shows the corresponding circuit for collar 5, the circuits for collars 6 to 8 being similar to that for collar 5. In each control circuit, the same reference numerals are used for corresponding elements, but with suffices corresponding to the number of the circuit.

The operator controls for crown and steer are shown in FIG. 2 and consists of a central zero crown magnitude control 14 which operates potentiometer 15 (FIG. 1), a similar steer magnitude control 16 which operates two ganged potentiometers 17 and 18, and slider type crown ratio controls 20–27 which operate independently potentiometers $28_1$, $28_2$–$28_8$ in the individual position control circuits.

Each position control circuit has three inputs:

1. line 30 from a transducer on the rack of the associated collar carrying a signal representing the position of the rack and hence the displacement of the collar from its central position.
2. the output on line 31 from crown magnitude potentiometer 15; that output is applied in common to all eight circuits.
3. (a) for the control circuits for collars 1 to 4, the output on line 32 from steer magnitude potentiometer 17 or
3. (b) for the control circuits for collars 5 to 8, the output on line 33 from steer magnitude potentiometer 18.

It will be observed from the power supplies to potentiometer 17 and 18 that they give equal outputs of opposite polarities.

In each control circuit, the transducer signal on line 30 is applied through amplifier 35 to a summing amplifier 36. The signal from potentiometer 15 is applied in parallel through amplifier 37 to one end of potentiometer 28 and to inverter 38; the output of inverter 38, which is equal and opposite to the output of amplifier 37, is applied on line 40 to the other end of potentiometer 28, the tap of which is connected as a second input of amplifier 36. Potentiometer 17 or 18 is connected on line 32 or 33 to amplifier 41 the output of which is applied through steer trim potentiometer 42 as a third input of summing amplifier 36.

According to the polarity of the output of amplifier 36, one or other of reed relays 43, 44 is energised to actuate UP relay 12 or DOWN relay 13 respectively. The control system operates to maintain the input to amplifier 36 to zero, so that the hydraulic motor of the collar associated with the circuit is driven to a displacement proportional to the sum of the amplifier inputs from potentiometers 28 and 42.

When the crown magnitude potentiometer 15 is at zero and/or all the crown ratio potentiometers $28_1$–$28_8$ are set at zero, the roll has zero crown. To apply a crown, the operator first sets crown magnitude control 14 at zero so that there is no output on line 31, and then operates the ratio controls 20 to 27 to the required relative positions of the collars. FIG. 2 shows by way of example the setting of controls 20 to 27 to give displacements fo crowns 1 to 8 from their zero displacement positions in ratios of 30, 50, 70, 100, 100, 70, 50, 30. No movement of the collars occur, since there is no input signal on line 31. The differences in setting between consecutive collars should be limited to a preset safe amount.

The operator next moves control 14 from zero in the positive direction. The resulting signal on line 31, causes signals to appear on the outputs of potentiometers $28_1$ to $28_8$ in the set ratios and causes the hydraulic motors to operate to produce corresponding displacements of the collars. As the control 14 is progressively advanced, all eight collars are simultaneously adjusted towards their final positions which are determined by the position to which potentiometer 15 is finally set. For example if, as shown, controls 23 and 24 are preset at 100%, representing maximum displacement and if control 14 is set at 60% (of maximum displacement), collars 4 and 5 will be displaced from the central positions through 60% of its possible travel and the other collars proportionally; as set, collars 2 and 7 do not move from their central positions while collars 1 and 8 move in the opposite direction.

Negative camber can be applied by turning control 14 in the negative direction, resulting in a negative voltage appearing on line 31.

Because all collars are displaced simultaneously, crown control occurs smoothly and without any of the racks stalling.

The steer trim potentiometers $42_1$ to $42_8$ are preset and are not subject to alteration by the operator. They are set to give outputs in given ratios e.g. 7-5-3-1-1-3-5-7 for the respective collars 1 to 8. Assuming no crown control has been applied, i.e. potentiometer 15 is at zero, and steer control is to be effected, control 14 is turned to the right for right steer and to the left for left steer. In the former case, a positive voltage is delivered on line 32 and a negative voltage on line 33. Those voltages are applied respectively to amplifiers $41_1$ to $41_4$ and to amplifiers $41_5$ to $41_8$. If the magnitude of those voltages is X then the signals from potentiometers $42_1$ to $42_8$ are proportional to $7\times$, $5\times$, $3\times$, $\times$, $-\times$, $-3\times$, $-5\times$, $-7\times$ and the hydraulic motors are operated to give proportional displacements of the collars, causing the respective work roll to be inclined without camber relative to the other work roll. As before, the collars are displaced simultaneously, their final positions being determined by the final setting of control 16.

If control 16 is turned from the centre zero position to the left, the outputs from potentiometers 17 and 18 are negative and positive respectively and the motors are operated to incline the respective roll in the opposite direction.

It will be appreciated that the crown and steer controls can be operated simultaneously, the shape required for steer being superimposed on the crown applied.

Modifications of the circuit shown in FIGS. 1A and 1B are possible. For example, the two steer potentiometers 17 and 18 may be replaced by a single potentiometer the signal from which is applied to all eight control circuits; in that case however the amplifiers 38 of circuits 5 to 8 are made inverting buffer amplifiers.

In a further modification, the UP and DOWN relays 12 and 13 of each hydraulic motor and the associated valves are replaced by a servo flow valve, such as that sold under the name MOOG, controlled by the output of the corresponding summing amplifier 36. A very accurate and smooth control of the collars results.

What I claim is:

1. Control equipment for at least some of the eccentrically mounted collars of a cluster mill, comprising:

(a) a control circuit for each said controlled collar for setting said collar to a determined displacement;

(b) a control signal generating circuit for each said controlled collar;

(c) means for generating a first magnitude signal proportional to a desired crown magnitude;

(d) means for generating from said first magnitude signal a series of crown datum signals, one for each said controlled collar, said series of crown datum signals being proportional to said first magnitude signal in a preselected ratio;

(e) selection means for preselecting said ratio;

(f) means for supplying a position signal representing the displacement of each said controlled collar;

(g) each of said control signal generating circuits being connected to receive an associated one of said crown datum signals and a corresponding position signal;

(h) whereby each said control signal is dependent on the difference between its said position signal and the associated crown datum signal.

2. Control equipment according to claim 1, in which said selection means are manually operable.

3. Control equipment according to claim 1, including (a) means for generating a second magnitude signal proportional to a desired steer magnitude; and (b) means for generating a second series of steer datum signals which are proportional to said second magnitude signal and in a preset ratio to one another, and which are applied to associated ones of said control signal generating circuits;

(c) whereby each said control signal is dependent on the sum of said associated steer and crown datum signals.

4. Control equipment according to claim 1, in which said means for deriving said series of crown datum signals comprises a pair of lines carrying signals have equal magnitudes representing said first magnitude signal but of opposite polarities; a series of potentiometers each connected between said pair of lines and each having an adjustable tap point connected to said selection means.

5. Control equipment according to claim 1, in which said first magnitude signal and thus said series of signals are positive or negative to effect positive or reverse crown.

6. Control equipment according to claim 3, in which said means for deriving said second magnitude signal comprises means for deriving two signals of equal magnitude and opposite polarity, one associated with collars on one half of the roll barrel length and the other associated with collars on the other half of the roll barrel length.

* * * * *